United States Patent [19]

Sugiyama

[11] 4,355,800

[45] Oct. 26, 1982

[54] PAPER FEED CONTROL APPARATUS FOR USE IN SHEET PRINTING PRESSES

[75] Inventor: Hiroyuki Sugiyama, Toride, Japan

[73] Assignee: Komori Printing Machinery Co., Ltd., Tokyo, Japan

[21] Appl. No.: 253,073

[22] Filed: Apr. 10, 1981

[30] Foreign Application Priority Data

Apr. 22, 1980 [JP] Japan ..... 55-52323

[51] Int. Cl.[3] ..... B65H 9/14

[52] U.S. Cl. ..... 271/229; 271/245; 271/276

[58] Field of Search ..... 271/229, 231, 237, 244, 271/245, 276, 98, 195

[56] References Cited

U.S. PATENT DOCUMENTS 3,370,847 2/1968 Weidman ..... 271/229

3,870,293 3/1975 Simeth ..... 271/231

*Primary Examiner*—Richard A. Schacher

*Attorney, Agent, or Firm*—Charles E. Pfund

[57] ABSTRACT

A feed plate for sequentially supplying paper sheets to a printing press is provided with an upwardly inclined air passage and an air suction passage obliquely intersecting the upwardly inclined air passage at an intermediate point thereof. A guide plate is provided to extend through the upwardly inclined air passage to confront inner opening of the air suction passage.

4 Claims, 12 Drawing Figures

PAPER FEED CONTROL APPARATUS FOR USE IN SHEET PRINTING PRESSES

BACKGROUND OF THE INVENTION

This invention relates to apparatus for controlling a paper sheet transferred on a feed plate of a paper feed apparatus of a sheet printing press so as to correctly engage the paper to the front stop fingers at the end of the feed plate.

A sheet printing press generally comprises a paper feed device which feed one after one paper sheets (hereinafter merely called paper) stacked on a paper stack pedestal, a printing unit for printing the paper fed and a paper discharge device which discharges printed paper to a paper stack. In the latter half of the path of paper of paper feed device are provided a tape roller which arrests a paper sheet sucked by a sucker in the fore half of the path and then sends out the sucked paper sheet, and a paper feed tape which transfers the sent out paper sheet. The paper sheet transferred by the paper feed tape is sent onto a feed plate and stopped with its fore end engaged by front stop fingers, and then gripped by a swinging device to be delivered to an impression cylinder.

In order to prevent not aligned printings it is necessary to correctly control the position of the fore end of the paper with the front stop fingers. With the prior art apparatus, the fore end is not always correctly controlled. Especially when printing paper with curved front end or when printing again paper once printed, or a thick card board, paper often jumps over the front stop fingers, thus breaking the paper or degrading the quality of the printed matter.

SUMMARY OF THE INVENTION

Consequently, it is an object of this invention to provide an improved paper feed control apparatus capable of positively urging paper sheets to be printed and stopping the same at correct positions even when the front ends of the sheets are curved or bent up.

Another object of this invention is to provide an improved paper feed apparatus for use in a printing press capable of preventing in current alignment of prints, thereby improving the quality of the printed matter.

According to this invention, there is provided a paper feed control apparatus for use in a sheet printing press comprising means for sequentially feeding paper sheets to the printing press along a predetermined paper feed path, a front stop finger provided at one end of the path and at a position close to the printing press, a feed plate positioned near the front stop finger, the feed plate being provided with a upwardly inclined air passage opened near the front stop finger, and an air suction passage extending between an intermediate point of the inclined air passage and an upper surface of the feed plate, a guide plate extending through the inclined air passage and spaced from an inner opening of the air suction passage, and means for supplying pressurized air to a lower end of the inclined air passage.

DESCRIPTION OF THE PREFERRED EMBODIMENT

Figure 1:
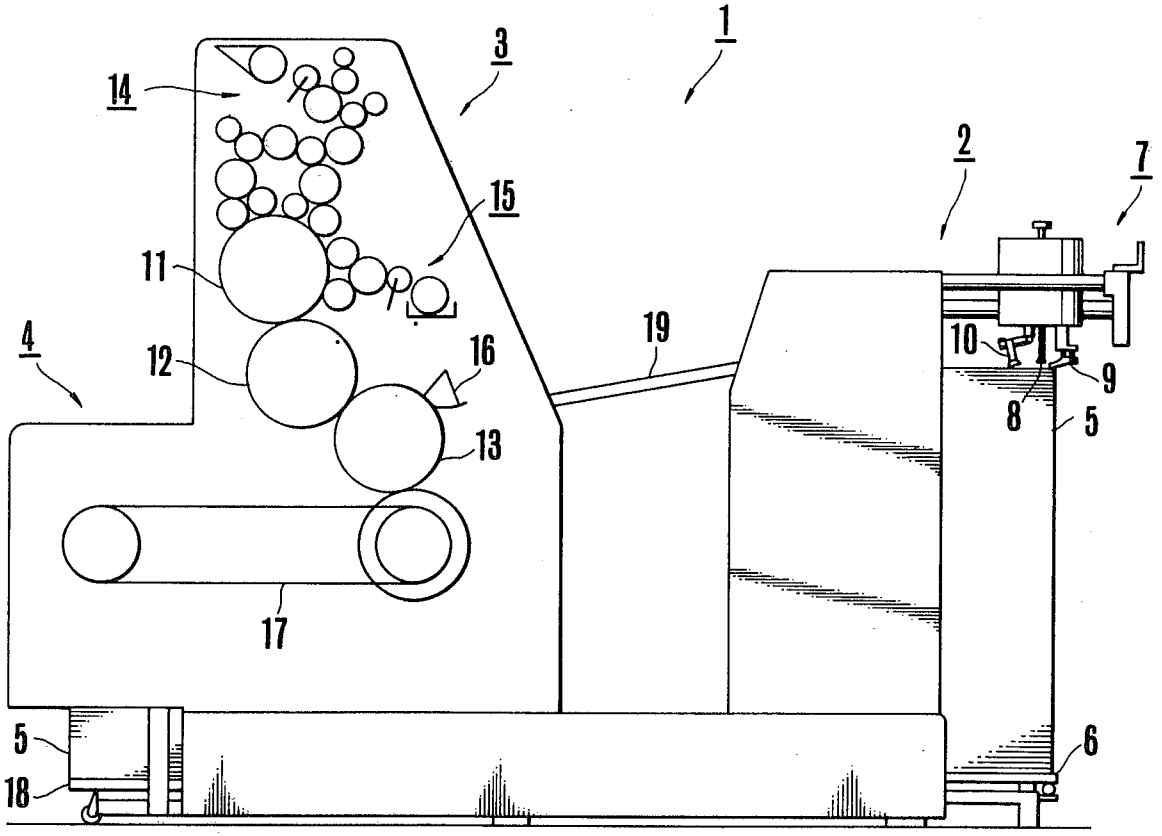
FIG. 1 is a diagrammatic side view of a monocolour sheet printing press embodying the invention.

Referring now to the accompanying drawings, a printing press 1 comprises a paper feed device 2, a printing unit 3 and a paper discharge device 4. The paper feed device 2 comprises a paper stack pedestal 6 on which paper sheets 5 are stacked, and a sucker 7 which sucks the uppermost paper of the stack and then sends out the sucked paper. The sucker 7 comprises a first suction port 8 which sucks paper 5, a blow foot 9 which blows air beneath the sucked paper 5 for enhancing separation of paper sheets, and a second suction port 10 which sucks paper 5 and send it forwardly. The printing unit 3 comprises a group of rollers made up of a platen roller 11, a rubber roller 12 and an impression roller 13, an ink fountain device 14 for supplying printing ink to the platen roller 11, and a water feed device 15 for supplying water to the platten roller 11. A swinging device 16 is provided above the impression cylinder 13 to deliver paper 5 sent from the paper feed device 2 to the impression roller 13. The discharge device 42 comprises a paper discharge chain 17 provided with a number of pawls, not shown, and a paper stack pedestal 18 is located beneath the output end of the chain 17 for stacking papers released from the pawls.

In the printing press described above, a paper feed path 19 shown in FIG. 2 is formed between the sucker 7 and the swinging device 16 of the printing press 1. Thus, at the starting end of the paper feed path 19, there are provided vertically aligned paper feed roller 20 and a paper roller 21, these rollers cooperating to catch the front end of paper sheet 5 sucked and conveyed by the second suction port 10 of the sucker 7. A front tape roller 22 is disposed between the swinging device 16 and the tape roller 21. A plurality of paper feed tapes or endless belts 25 are passed about the tape rollers 21, 22 and tension rollers 23 and 24. These tapes are inclined towards the front end and have a sectional configuration of a narrow triangle. Supporting arms 26 are provided between the tape rollers 21 and 22 on both sides of the paper feed path for supporting a feed board 27 with its upper surface positioned close to the rear surface of the paper feed tape. A feed plate 28 having a substantially equal width as the feed board 27 is supported by the supporting arm 26 to be coextensive with feed board 27. A front finger shaft 29 is rotatably jounalled at the fore end of the feed plate 28 for supporting a plurality of parallel front fingers 30, the upper ends thereof being received in notches formed at the front end of the feed plate 28. A plurality of paper feed rollers 31 are provided above the paper feed tape 25 for clamping paper therebetween.

Figure 5:
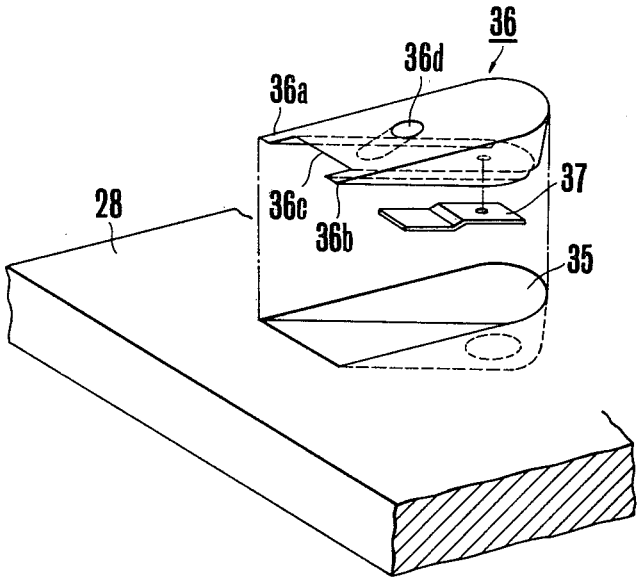
FIG. 5 is a perspective exploded view showing the detail of a recess and a cap contained therein for defining air passages.
Figure 4:
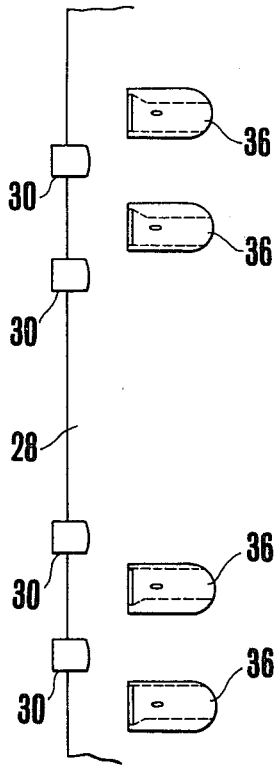
FIG. 4 is a plan view showing the paper feed control device shown in FIG. 3.
Figure 6:
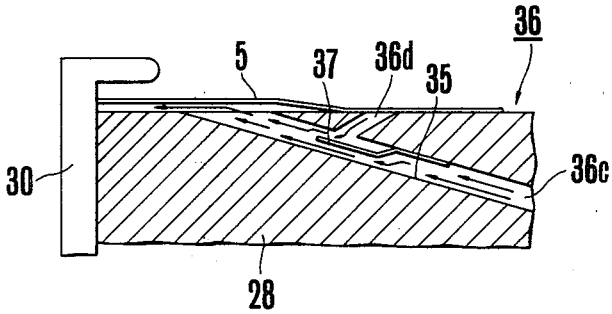
FIG. 6 is a sectional view showing air passages formed by securing the cap in the recese and FIGS. *7a* through *7f* are sectional views useful to explain the control of the paper feed operation.

L shaped air ducts 32 are provided beneath the feed plate 28 near its front end, and connected with a blower 34 via valves 33 for discharging pressurized air by opening and closing valves 33 at a predetermined timing. The feed plate 28 is formed with a plurality of triangular recesses 35 and the air ducts 32 open to these recesses. A stationary triangularlcaps 36 is contained in each recess 35. A narrow air passage 36*c* is defined between the bottom surface of the cap 36 and the bottom surface of the recess 35 except both side ends 36*a* and 36*b* (see FIG. 5). Thus, the air supplied from the air ducts 32 flows through the air passages 36*c* and ejected upwardly a short distance before the front stop fingers 30. An inclined air suction passage 36*d* is provided for each cap 36 and a guide plate 37 is secured to the bottom of the cap to extend through the air passage 37 in front of the inner opening of the air suction passage 36*d*. The guide plate 37 divides the air passage 36*c* into two halves.

Figure 2:
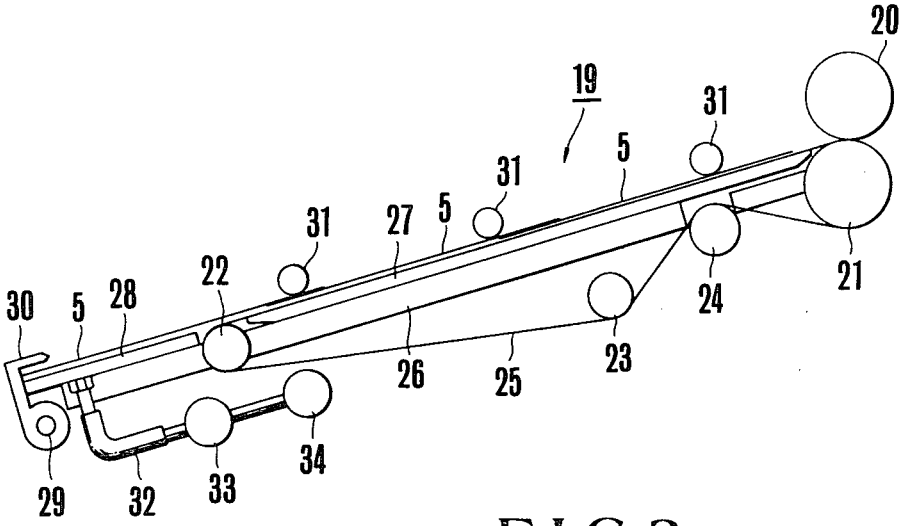
FIG. 2 is a diagrammatic side view showing a path of paper fed.
Figure 3:
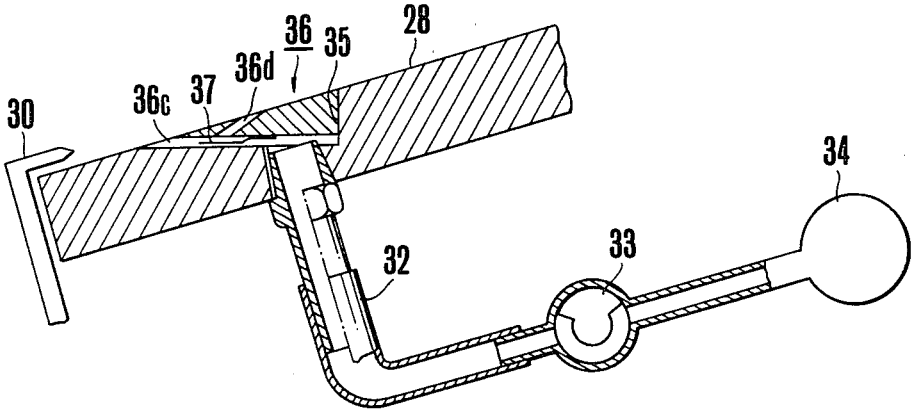
FIG. 3 is a sectional view of a paper feed control device.

In operation, paper sheets 5 stacked on the paper stack pedestal 6 are conveyed, one after one, by the sucker 7 and the front ends of papers are fed into a nip between rollers 20 and 21. As shown in FIG. 2, the paper sheets thus fed are sent onto the paper feed tape 25 with the ends of successive sheets overlapped. Thus, the sheets are clamped between the paper feed tape 25 and the paper feed rollers 31 and transferred along the upper surface of the feed board 27 onto the paper feed plate 28 until stopped by front stop fingers 30. Then, the swinging device 16 is swing to grip the paper end with its gripping pawls for delivering the paper to the gripping pawls of the impression cylinder 13.

Figure 7:
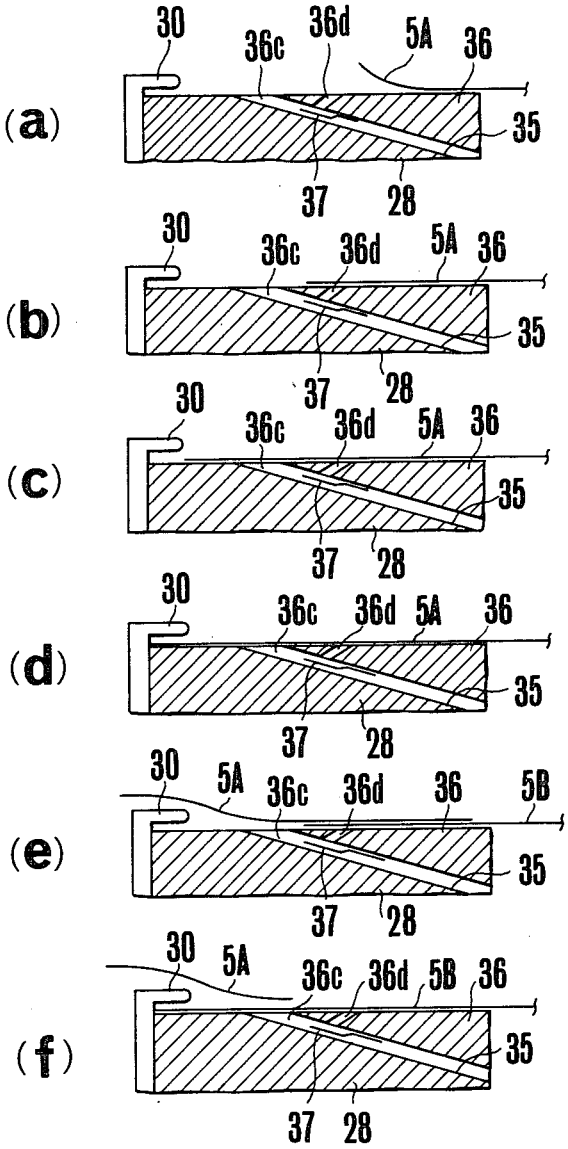

The control of the paper feed operation described above will be described as follows with reference to FIGS. 6 and 7*a* through 7*f*. Suppose now that paper 5A having a curved or bent end is fed as shown in FIG. 7*a* and that this curved end reaches the air suction passage 36*d* as shown in FIG. 7*b*. As the air flows upwardly through the air passage 36*c*, outside air is sucked into the passage 36*c* via air suction passage 36*d* whereby the curved end of the paper 5A would be urged against the upper surface of the feed plate 28. As the front end of the paper 5A passes by the opening of air passage 36*c*, as shown in FIG. 7*c*, the air ejected from the opening is blown into the space between the paper 5A and the feed plate 28 toward the front stop fingers 30. The air flow creates a partial vacuum beneath the paper so that its front end would be urged against the upper surface of the feed plate by atmospheric pressure. Due to the provision of guide plate 37, the air flowing through the air passage 36*c* flows through a lower half beneath the guide plate 37, thus separating the air from that sucked by air suction passage 36*d*. This construction enhances air suction and increases the external pressure applied to the upper surface of the paper 5A. The front end of paper 5A thus urged against the feed plate 28 comes to engage the front stop finger 30 as shown in FIG. 7*d*, thus correctly controlling the position of the paper end. At this time, since the paper 5A is urged against the feed plate 28 there is no fear of being blown upwardly to the above of the front stop fingers 30, but instead the front end of the paper 5A correctly abouts against the inner surface of the stop fingers 30. At this time, the gripping pawls of the swinging device 16 are brought close to the front end of the paper to grip the same, and at the same time the front stop fingers 30 are resiprocated with respect to the feed plate 28 and caused to inter beneath the paper 5A as shown in FIG. 7*e*. At this time, the front end of the succeeding paper 5B has been brought to the opening of the air suction passage 36*d*, and as the delivering operation of the swinging device 16 proceeds the front end of the suceeding paper 5B comes to abut the stop fingers 30 as shown in FIG. 7*f*. Thereafter, the same operation is repeated.

Instead of forming the air passage 36*c* beneath the cap 36, the air passage may be formed at the bottom of the recess.

With the air passage construction described above, the front end of the paper sheet is positively urged against the feed plate so that the sheet is prevented from jumping beyond the front stop fingers and correctly positioned which prevents inacurate alignment of prints and improves the quality of the printed matters. Moreover, the guide plate enhances suction of external air into the air passage 36*c* thus improving the urging of the paper sheet against the paper feed plate.

What is claimed is:

1. A paper feed control apparatus for use in a sheet printing press comprising means for sequentially feeding paper sheets to said printing press along a predetermined paper feed path, a front stop finger provided at an end of said path and at a position close to said printing press, a feed plate positioned near said front stop finger, said feed plate being provided with an upwardly inclined air passage opened near said front stop finger, and an air suction passage extending between an intermediate point of said inclined air passage and an upper surface of said feed plate, a guide plate extending through said inclined air passage and spaced from an inner opening of said air suction passage, and means for supplying pressurized air to a lower end of said inclined air passage.

2. The paper feed control apparatus according to claim 1 wherein said feed plate is formed with a recess having a substantially triangular configulation, and a cap having a similar configulation to that of said recess is secured in said recess so as to define said upwardly inclined air passage between a lower surface of said cap and a bottom surface of said recess, said cap being formed with said air suction passage obliquely intersecting with said upwardly inclined air passage at an intermediate point thereof.

3. The paper feed control apparatus according to claim 1 or 2 wherein pressurized air is supplied to an lower end of said upwardly inclined air passage and said guide plate is secured to the bottom surface of said cap to divide said upwardly inclined air passage into upper and lower sections, lower end of said lower section being closed by said guide plate.

4. The paper feed control apparatus acording to claim 1 wherein said front stop finger is reciprocated with respect to a front end of said feed plate so as to release the front end of said paper sheet to be blown upwardly by pressurized air.

* * * * *